US006849998B2

(12) United States Patent
Shaffer

(10) Patent No.: US 6,849,998 B2
(45) Date of Patent: Feb. 1, 2005

(54) AMALGAM RETAINER

(75) Inventor: John W. Shaffer, Danvers, MA (US)

(73) Assignee: Osram Sylvania Inc., Danvers, MA (US)

( * ) Notice: Subject to any disclaimer, the term of this patent is extended or adjusted under 35 U.S.C. 154(b) by 89 days.

(21) Appl. No.: 09/925,582

(22) Filed: Aug. 9, 2001

(65) Prior Publication Data

US 2002/0070661 A1 Jun. 13, 2002

Related U.S. Application Data

(60) Provisional application No. 60/255,012, filed on Dec. 12, 2000.

(51) Int. Cl.[7] ..... H01J 61/28; F04B 37/02

(52) U.S. Cl. ..... 313/490; 313/560; 417/48

(58) Field of Search ..... 313/475, 485, 313/490, 545, 546, 550, 562, 564, 565, 560, 566, 631, 30, 22, 35, 632, 623, 42, 31; 315/248; 445/9, 26

(56) References Cited

U.S. PATENT DOCUMENTS 5,075,160 A * 12/1991 Stinton et al. ..... 442/247
5,629,584 A * 5/1997 Borowiec et al. ..... 313/565
5,828,169 A * 10/1998 Myojo et al. ..... 313/475

FOREIGN PATENT DOCUMENTS

JP 54069271 * 4/1979 ..... 313/552

* cited by examiner

*Primary Examiner*—Joseph Williams
(74) *Attorney, Agent, or Firm*—Carlo S. Bessone

(57) ABSTRACT

An arc discharge lamp has an arc chamber with an amalgam tip attached to and communicating with the arc chamber through a constricted area. An amalgam retainer is positioned in the arc chamber and is abutted against the constricted area. The amalgam retainer is vibration-insensitive, solid and liquid amalgam impervious and mercury vapor pervious. An amalgam is contained within the amalgam tip.

6 Claims, 2 Drawing Sheets

AMALGAM RETAINER

This application claims priority from Provisional Patent Application No. 60/255,012, filed Dec. 12, 2000.

TECHNICAL FIELD

This invention relates to an amalgam retainer for an arc discharge lamp and more particularly to an amalgam retainer for an electrodeless lamp.

BACKGROUND ART

Many arc discharge lamps rely for operation on the presence of mercury in the arc stream. The mercury is present, when the lamp is not operating, as elemental mercury or as a solid or liquid amalgam. In some types of lamps, particularly electrodeless fluorescent lamps such as those shown in U.S. Pat. Nos. 5,717,290 and 5,834,905, it is important to keep the solid or liquid amalgam from settling within the arc environment where it can cause changes in the lumen output and the lumen-temperature performance of the lamp.

DISCLOSURE OF INVENTION

This invention solves the above-described problem by providing an arc discharge lamp that has an arc chamber with an amalgam tip attached to and communicating with the arc chamber through a constricted area. An amalgam retainer is positioned in the arc chamber and is abutted against the constricted area. The amalgam retainer is vibration-insensitive, solid and liquid amalgam impervious and mercury vapor pervious. An amalgam is contained within the amalgam tip.

BEST MODE FOR CARRYING OUT THE INVENTION

For a better understanding of the present invention, reference is made to the following description and appended claims, taken in conjunction with the above-described drawings.

Figure 1:
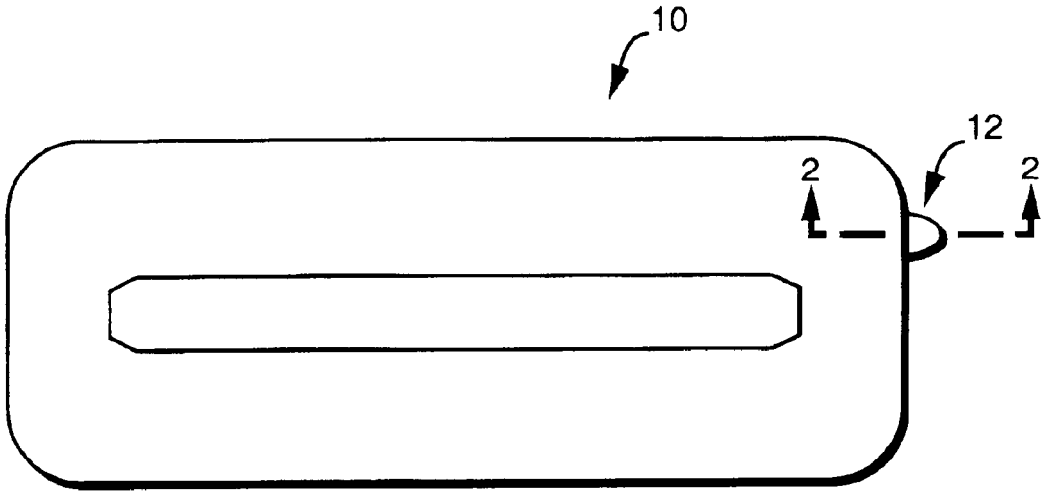
FIG. 1 is a plan view of an electrodeless lamp.
Figure 2:
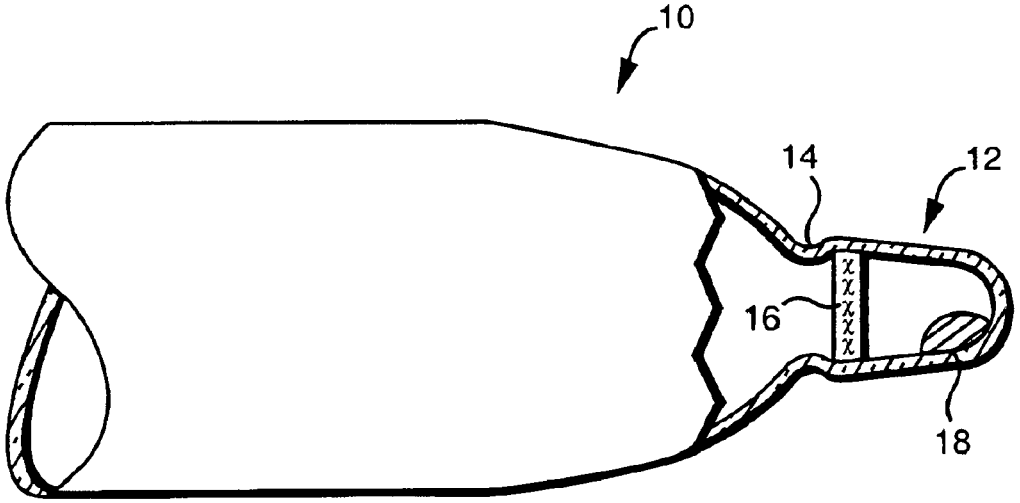
FIG. 2 is a sectional view taken along the line 2—2 of FIG. 1.

Referring now to the drawings with greater particularity, there is shown in FIG. 1 an electrodeless lamp 10 with the external electrical couplings omitted for purposes of clarity. Such a lamp can be of the type shown in the U.S. patents mentioned above, that is, a low pressure, electrodeless fluorescent lamp. The lamp 10 has an amalgam tip 12 attached to and communicating with the interior of the lamp 10 through a constricted area 14. The constricted area 14 is shown most clearly in FIG. 2. In the present illustration, constricted area 14 is shown as a "necked down" section of the amalgam tip; however, other constricted areas are suitable, such as the formation of a small diameter hole in the lamp body and the attachment of an amalgam tip with a larger diameter. Other equivalent structures would also be workable.

An amalgam retainer 16 is positioned in the amalgam tip 12 and is abutted against the constricted area 14. The amalgam retainer is preferably held in position by a friction fit, as will be explained hereinafter. The amalgam retainer 16 is constructed of a material that is vibration-insensitive; that is, it will maintain its position through any normal amount of vibration that the lamp could reasonably be subjected to in shipping or in usage. Further, the amalgam retainer must be impervious to solid and liquid amalgams and yet be pervious to mercury vapor.

An ideal material that meets these qualifications is a ceramic felt composed of fibers of mixed aluminum and silicon oxides. Preferably the fibers have a diameter of <10 microns.

Such a material is available from Contronics Corporation, Brooklyn, N.Y. as 'Contronics™ type 300' Ceramic Paper in sheet form having a thickness of ⅛ inch. In the specific application discussed herein, amalgam retainers with a diameter of 4.8 millimeters were cut from this ⅛ inch thick material and inserted into an amalgam tip having an inside diameter of 4.0 millimeters. The constricted area had an inside diameter of about 3.5 millimeters.

Figure 3:
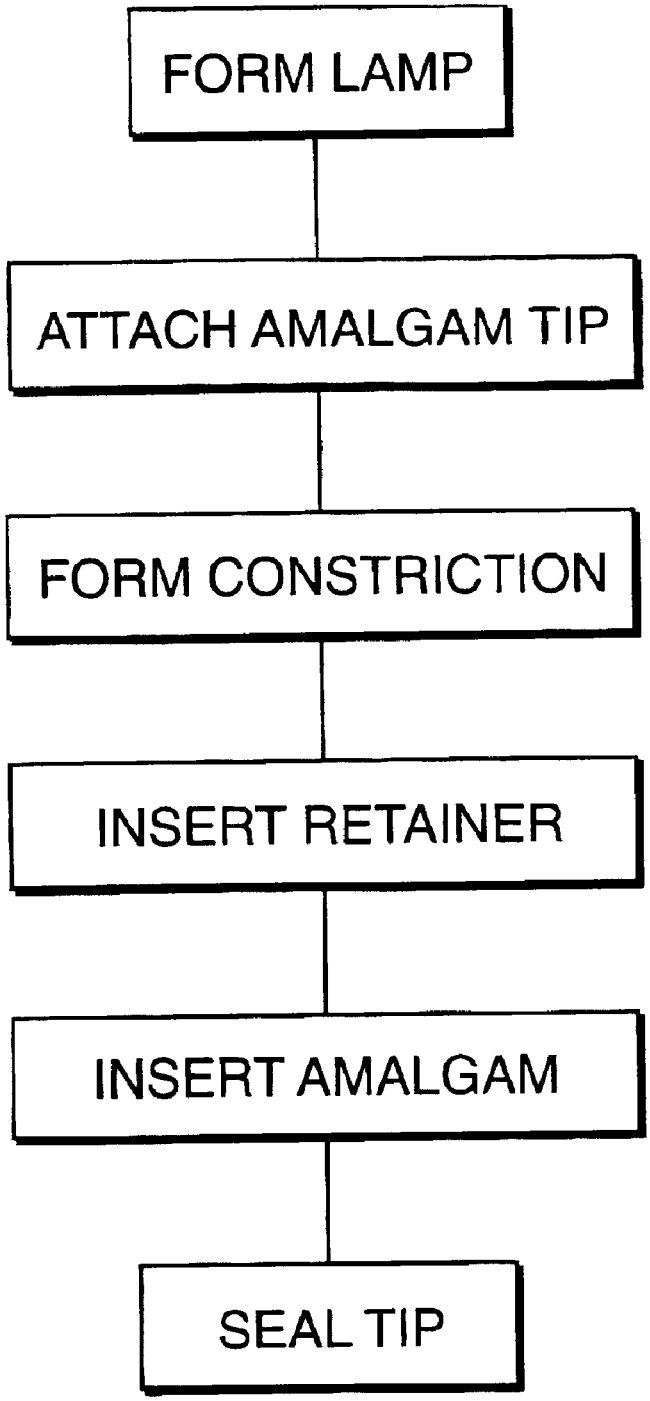
FIG. 3 is a flow diagram of an assembly operation for making a lamp.

The complete assembly takes the form of the steps shown in FIG. 3. That is, first the lamp body is formed and then the amalgam tip, in the form of a tube having the aforesaid 4.0 millimeter internal diameter is attached. The constricted area 14 can be formed at the some time as the tube attachment or subsequently. Next, the amalgam retainer 16 is inserted into the amalgam tip by compressing it to the correct diameter. It is then held in place by friction as its compressive forces exert a pressure against the wall of the amalgam tip. The solid or liquid amalgam 18 is then inserted and the tip is sealed. When the lamp employing the amalgam retainer is an electrodeless fluorescent lamp, the amalgam preferably includes bismuth and indiuim.

When tested in operating lamps (150 watt ICETRON™ lamps, available from Osram Sylvania Inc., Danvers, Mass.) having the amalgam tip temperature controlled at 125° C. (at which temperature the amalgam is fully molten) all lamps showed complete amalgam containment. The test conditions used were high acceleration vertical sinusoidal vibration with frequency varied from 4 to 25 Hz, maximum acceleration 4 g's at 12 and 25 Hz, maximum velocity 0.520 meters/second, and a maximum displacement of 17.27 millimeter peak-to-peak. Lamps were tested in both horizontal and vertical positions. The vertical position had the amalgam tip uppermost.

The use of the amalgam retainer described herein provides a low cost and reliable means for retaining the amalgam within the amalgam tip of fluorescent lamps, thus providing lamps which are rendered omni-positional with regard to mounting in fixtures and lighting applications and will provide stable performance under severe vibration applications such as can be encountered in post-top or pole mounted fixtures on bridges.

Other porous ceramic papers or felts having very fine inorganic or non-metallic surface fibers can be used, so long as they are free of volatile or organic binders. If present, any such binders must be removed prior to use in lamps.

While there have been shown and described what are at present considered to be the preferred embodiments of the invention, it will be apparent to those skilled in the art that various changes and modification can be made herein without departing from the scope of the invention as defined by the appended claims.

What is claimed is:

1. An arc discharge lamp comprising:

an arc chamber;

an amalgam tip attached to and communicating with said arc chamber through a constricted area;

an amalgam retainer of ceramic felt in said arc chamber abutted against said constricted area, said amalgam retainer being vibration-insensitive, solid and liquid amalgam impervious and mercury vapor pervious; and an amalgam contained within said amalgam tip.

2. The arc discharge lamp of claim 1 wherein said ceramic felt is comprised of fibers of mixed aluminum and silicon oxides.

3. The arc discharge lamp of claim 2 wherein said fibers have a diameter of <10 microns.

4. The arc discharge lamp of claim 3 wherein said lamp is a low pressure discharge lamp.

5. The arc discharge lamp of claim 4 wherein said amalgam includes bismuth and indium.

6. The arc discharge lamp of claim 4 wherein said amalgam tip has a given diameter and said amalgam retainer, prior to insertion, has a larger diameter.

* * * * *